United States Patent [19]

Ginalski et al.

[11] 4,351,042

[45] Sep. 21, 1982

[54] TIMEPIECE INCLUDING A STORAGE ARRANGEMENT

[75] Inventors: Pierre Ginalski, St-Maurice; Pierre-Luc Gagnebin, Bienne, both of Switzerland

[73] Assignee: Societe Suisse pour l'Industrie Horlogere Management Services S.A., Bienne, Switzerland

[21] Appl. No.: 201,673

[22] Filed: Oct. 28, 1980

[30] Foreign Application Priority Data

Nov. 5, 1979 [FR] France ..... 79 27619

[51] Int. Cl.[3] ..... G04C 9/00

[52] U.S. Cl. ..... 368/188; 368/203

[58] Field of Search ..... 368/66, 76, 80, 51, 368/187, 188, 189, 203, 204

[56] References Cited

U.S. PATENT DOCUMENTS

| | | | |
|---|---|---|---|
| 3,828,278 | 8/1974 | Rees | 368/187 X |
| 3,830,052 | 8/1974 | Daniels et al. | 368/204 X |
| 3,939,644 | 2/1976 | Wolf | 368/189 X |
| 4,030,283 | 6/1977 | Sauthier et al. | 58/23 R |
| 4,036,008 | 7/1977 | Okamoto et al. | 368/187 |
| 4,059,955 | 11/1977 | Prak | 368/188 |
| 4,112,671 | 9/1978 | Kato et al. | 58/23 D |
| 4,130,988 | 12/1978 | Scherrer et al. | 368/187 X |
| 4,150,536 | 4/1979 | Nakajima et al. | 58/23 D |
| 4,177,632 | 12/1979 | Burki et al. | 58/23 BA |
| 4,177,632 | 12/1979 | Burki et al. | 368/187 |
| 4,185,453 | 1/1980 | Jaunin | 58/35 R |
| 4,232,384 | 11/1980 | Jaunin | 368/185 |

FOREIGN PATENT DOCUMENTS

| | | |
|---|---|---|
| 2513134 | 9/1975 | Fed. Rep. of Germany . |
| 2730330 | 1/1978 | Fed. Rep. of Germany . |

*Primary Examiner*—Bernard Roskoski

*Attorney, Agent, or Firm*—Griffin, Branigan & Butler

[57] ABSTRACT

The invention comprises an arrangement which permits placing a timepiece into a state of minimum energy consumption for storage purposes. It includes a manual control arranged to act on an electronic circuit. When the manual control is briefly actuated the minutes hand may be set to the minute, with a longer actuation causing the hands to advance through one time zone. Should the control be actuated while the hands are in motion during time zone adjustment the hands are stopped and the timepiece is in order for storage. The arrangement is applicable to timepieces which must be stored during a certain period and serves to conserve energy as well as to stop the hands in a uniform position for a collection on display.

7 Claims, 3 Drawing Figures

TIMEPIECE INCLUDING A STORAGE ARRANGEMENT

BACKGROUND OF THE INVENTION

This invention concerns an electronic timepiece comprising a time base, a frequency divider, a stepping motor driving minutes and hours indicating hands, and an electric switch manually actuable for setting the hands, all being arranged in such a manner that, responsive to a brief actuation of the switch the minutes hand steps through one minute, and responsive to a longer actuation of the switch the minutes hand makes a complete revolution at increased speed without stopping.

A timepiece of this type is known and has been set forth in U.S. Pat. No. 4,185,453. Herein there are no longer mechanical arrangements for correction and time setting and these are realized exclusively by electronic means. The correction arrangement is particularly simple and includes nothing more than a simple push button arranged for example in a manner to correspond to the normal position of the crown on a mechanical wrist-watch. The watch described comprises a stepping motor which is employed for driving directly the minutes hand and the hours hand through a system of planetary gears. The arrangement is such that the minutes hand makes a single step each minute thereby economising energy and permitting employment of a much smaller battery. The mentioned application describes a system which gives the possibilities:

(a) to obtain time setting of the minutes hand. A succession of short duration pulses (on the order of one second) on the push button has as and effect to step the motor, and thereby the minutes hand which is directly coupled thereto, through as many steps as there are pulses applied.

(b) to regulate the phase of the seconds although seconds are not displayed. That is to say, when a time signal is received the minutes hand should be located just at the point where the indication should change. A single short duration pulse (on the order of one second) on the push button at the moment of a zero second time signal will set the watch to the exact second. Should the watch be running several seconds slow this phase setting, as described, will have the effect of adding a single minute pulse. On the contrary if the watch is running fast the phase setting will set to zero the frequency divider without other effect.

(c) to change rapidly the hours hand setting in the case where the user changes time zones or when there is a change between Winter or Summer time as presently occurs in numerous countries. This change is effected by maintaining the button pushed during a longer time period (on the order of more than three seconds). The motor will then begin to turn rapidly (for instance at 32 steps per seconds). As soon as the hand has begun its motion, if one then releases the push button the minutes hand will advance rapidly 60 steps this corresponding to an advance of one hour. If the push button is maintained actuated the minutes hand will continue to turn. When it is released the hand will complete the set of 60 steps which has begun then will return to normal operation. During these operations precision is maintained.

The purpose of the present invention is to provide the timepiece described above with an additional function namely that it may be stopped in a state of minimum energy consumption or storage state, it being understood that it is uniquely the same push button which is employed for this new function.

Prior art electronic watches have been suggested in which is provided a storage state in order to diminish the energy consumption thereof.

German patent No. 27 30 330 describes a watch provided with a function selector of which a position or special condition of the logic circuit, referred to as storage, placed for reasons of convenience at the beginning or the end of the function control signal for possible functions, creates a signal which activates an erasing circuit and a temporisor. However, here the arrangement is intended for a timepiece which includes such a function selector which, for instance, permits obtaining, in turn, the storage condition, then the displays of hours and minutes or dates and seconds and finally the conditioning of the watch for time correction, this correction being necessarily realized by means of a special time corrector. This arrangement requires the provision of a temporisor or delay intended to avoid a loss of the hour when at the time that the functions are being selected the selector passes from one position to another through the storage position. As has been said above, the timepiece according to the present invention does not provide a function selector but solely a time corrector which reacts differently on the display according to whether the corrector is subject to a brief pressure (advance minute by minute) or a longer pressure (advancing at least one time zone or complete revolution of the minutes hand). It is not readily seen by what further action different from those above it will be possible to act on the push button in order to place the watch in the storage condition. It will be seen further on that it is during a period when the minutes hand is making its full revolution that actuation of the push button will place the watch in the state of reduced consumption. Such arrangement is neither described nor suggested in the above citation.

U.S. Pat. No. 4,030,283 describes a time setting system employing a single push button. A first actuation thereof causes the watch hands to be rapidly driven. A second actuation stops operation and a third actuation causes the hands to be restored to normal operation. In one variant it is foreseen that a cam fixed or coupled for instance to the seconds hand may cause automatic stopping at noon of the seconds hand. It will be noticed initially that the second actuation of the push button, or as a variant the action of the cam, has as a purpose to stop the hands in order to permit restarting at a time signal. Thus we are here concerned with time setting and not at all with placing in a storage condition which moreover has not been foreseen. Finally the cited patent publication does not correspond to the generic definition of the present invention which distinguishes between a short duration actuation (minutes setting) and the long duration actuation (hour or time zone setting) on the push button during which there may come into play the placing into the storage condition of the watch. Effectively in the cited publication the seconds hand is accelerated as soon as one actuates the push button and this regardless of the duration of the actuation.

German patent application No. 26 58 326 proposes an electronic timepiece provided with two push buttons $S_1$ and $S_2$. When the first of these is actuated the motor rotates in one sense and when the second is actuated the motor may turn in the other sense. In order to place the watch in the storage condition it is necessary to actuate simultaneously both push buttons. One may immediately see that what is disclosed in the cited publication not only does not correspond to the generic definition of this invention but furthermore requires the use of two switches to arrive at a storage condition of the watch, this not being the case in the invention about to be described.

It will be understood that the storage condition may be advantageous for several reasons. From the moment that the watch leaves the final inspection in the factory till the time when it is sold by a retailer, several months indeed years, may pass. If the energy source (battery) can be left connected permanently, but at a reduced load, storage load, and a simple manual control permits changeover from the reduced load to the normal load (normal operation of the watch), the life duration of the battery will be increased to a considerable degree. Moreover for aesthetic reasons the retailer prefers to present his watches in a state where the hands occupy all the same position, for example 10 minutes past 10. Finally the user of the watch himself may wish to place the watch in a storage state, this perhaps being the case for a timepiece worn only occasionally such as in the case of jewellery.

Another purpose of this invention is to provide several variants in order to bring the timepiece into the storage state. Such purposes may be attained through means as defined in the attached claims.

DETAILED DESCRIPTION OF THE DRAWINGS

Figure 1:
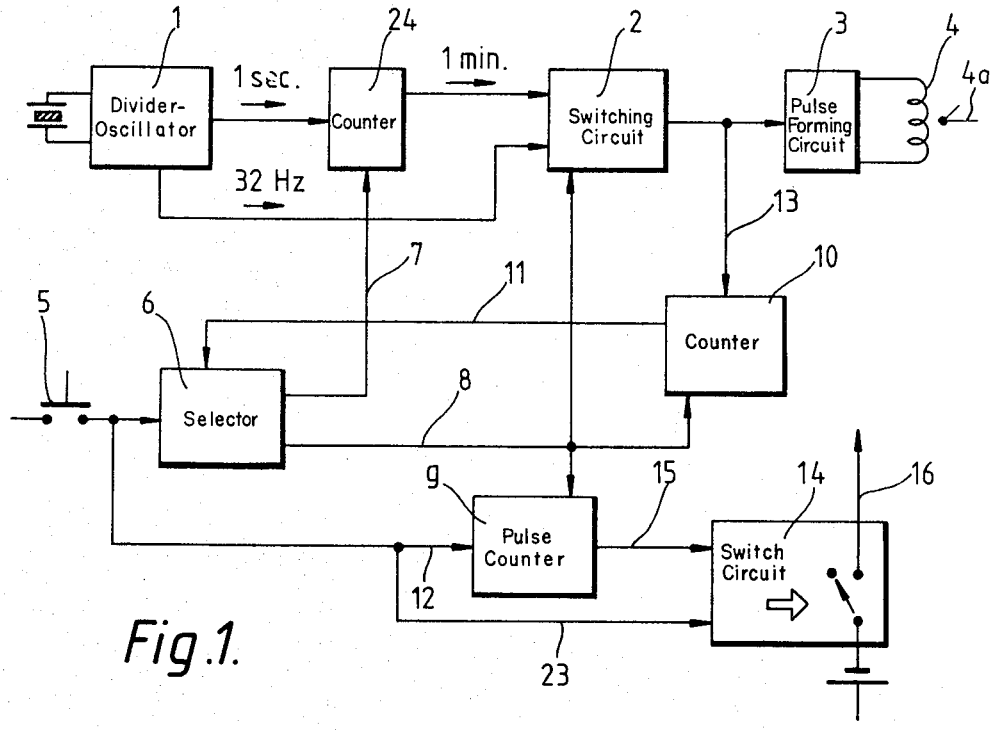
FIG. 1 is a block diagram showing a first variant of the invention.
Figure 2:
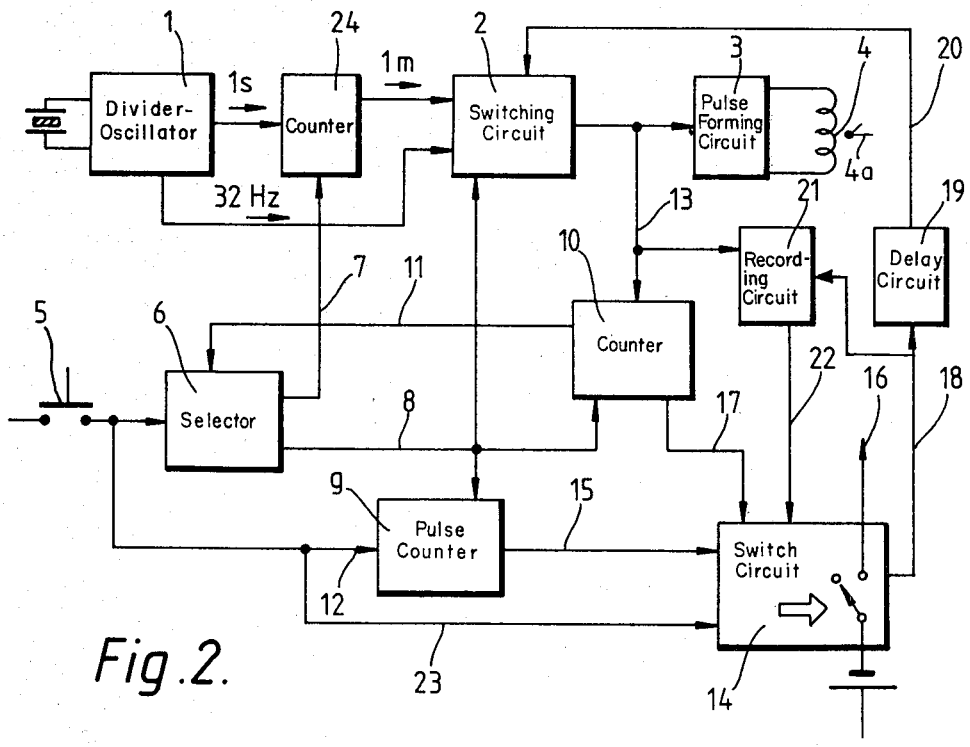
FIG. 2 is a block diagram showing a third variant according to the invention.

Both FIGS. 1 and 2 show a basic block diagram concerning the normal operation of the watch in respect of the time setting operation of the minutes hand and for setting the time zone for the hours hand in accordance with the prior art mentioned above.

At the output of the divider-oscillator 1 is obtained on the one hand a 32 Hz signal which is connected to the input of the switching circuit 2 and on the other hand a 1 second signal which is connected to the input of a counter 24 of which the output each minute is connected to the same switching circuit 2. The output of switching circuit 2 is applied to a pulse forming circuit 3 which provides motor driving pulses for the motor of which only the winding 4 is shown. In normal operation the motor receives one pulse each minute thus causing a minutes hand 4*a* to step one step each minute, since in the absence of information applied to the input of selector 6, the output 8 is in a logic state such that the switching circuit is switched onto the one minute signal. The same line 8 is adapted to block counter 10.

Should it now be desired to effect minutes setting of the minutes hand the push button 5 will be actuated during a brief instant (for instance one second). The correction mode selector 6 via line 7 sets counter 24 to zero which if it stores between 30 and 59 counts will send a correction impulse corresponding to one minute to the switching circuit 2 and hence to the motor 4. Further, short duration actuations on push button 5 subsequently cause the minutes hand to step once per actuation and continue to reset counter 24 to zero.

Should it be desired to advance the hands through one hour (a time zone) the push button 5 will be actuated during a longer time period (for example a time greater than three seconds). In this manner line 8 is activated which on one hand transfers the switching circuit 2 over to its input at 32 Hz and on the other hand enables counter 10. At this moment the output of switching circuit 2 transmits rapid advance pulses to the motor 4 while at the same rate filling counter 10 via line 13. When counter 10 reaches the limit of its capacity which is 60 it enables selector 6 via line 11. In turn selector 6 via line 8 positions switching circuit 2 to the input one minute (normal operation) and at the same time it blocks counter 10 at its zero contents. Thus the minutes hand 4*a* will be advanced through 60 divisions thereby completing one time zone or one complete revolution. It is evident that it will be necessary to release push button 5 before the minutes hand has completed its revolution if one should not wish to advance more than one revolution or time zone at a time.

As mentioned above, the timepiece includes in addition to the normal operation and correction functions as have just been explained an additional function which constitutes the object of the present invention and which permits placing thereof in a state of minimum consumption or storage state which will now be explained. In order to realize this latter function the same push button corrector 5 is employed as in a case of the time setting of the timepiece. It has just been seen that according to whether a long or short duration actuation has been applied to the push button, two functions, respectively minutes setting and hours setting, may be realized. The push button is thereby not available between these functions in order to activate the new storage function. On the other hand the invention profits from the fact that such availability is total while the minutes hand is running through a time zone or hour correction. The minutes hand achieves its revolution in 1.875 seconds when the frequency of the pulses applied to the motor is 32 Hz. It follows that during this time the push button may be actuated at least once in order to place the watch in its storage state.

FIG. 1 is a block diagram of the principle of the first variants of this invention. This variant includes in addition to the elements already described above a pulse counter 9 followed by a switch circuit 14 which cuts off all or part of the current feed for the timepiece. To place the watch in its storage state push button 5 is initially actuated during at least 3 seconds. This actuation provides a signal on line 8 and enables counter 9 to take into account the pulses arriving from 5 via line 12. As soon as the minutes hand has commenced its rapid motion the same push button will be actuated at least once, this having as effect to send a cut-off signal to the switch 14 via line 15. The switch circuit 14 interrupts the current feed line 16 which normally feeds at least the pulse forming circuit 3. At this moment the watch is placed in a storage state and in this variant the hands will stop at the instant that they have received this storage signal that is to say in any position whatsoever.

Figure 1A:
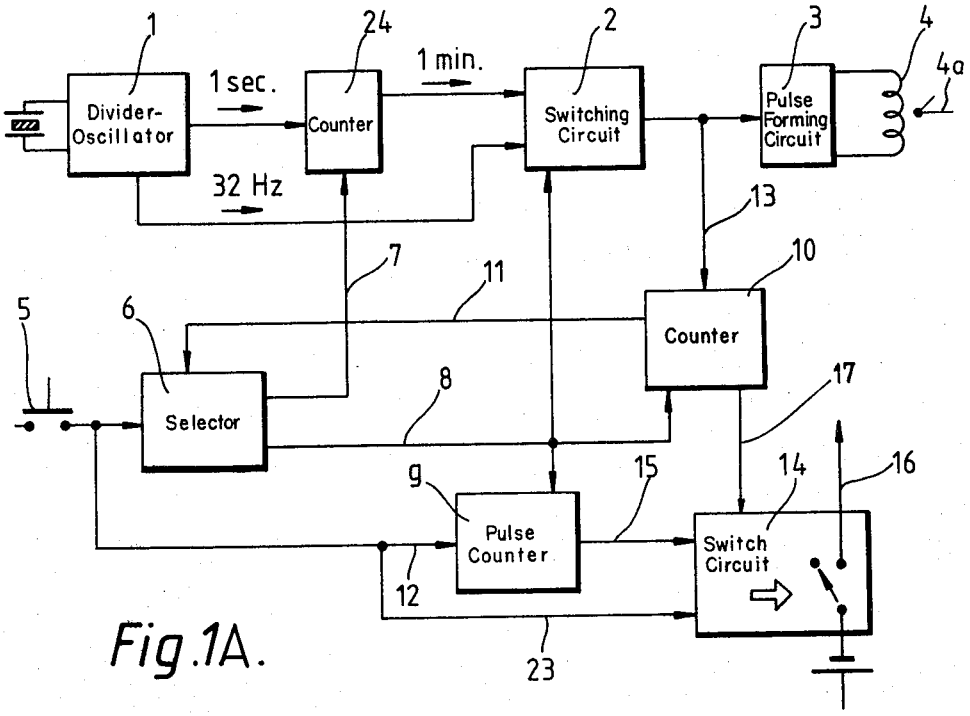
FIG. 1A is a block diagram showing a second variant of the invention.

The second variant according to the invention is illustrated by FIG. 1A wherein one finds in addition to elements 9 and 14 as described above, the line 17 coupling counter 10 to the switch circuit 14. At the beginning the operation is as in the first variant but the cut-off signal coming from counter 9 does not immediately cut-off the feed line 16. Effectively line 17 causes switch circuit 14 to delay the moment of storage until the moment when counter 10 has counted 60 pulses, that is to say at the moment when the revolution as controlled by the actuation greater than 3 seconds will have run its course. In other words in this variant the minutes hand, responsive to the storage pulse, completes its revolution before the watch is placed in its storage stage. The variant as described permits the retailer to store his watches in a state where all hands occupy the same position. Should the preferred storage position consist of the indication 10 hours 10 minutes, on a first operation the hands will be brought to 9 hours 10 minutes then in the second operation the push button will be actuated to cause an advance of one time zone or revolution, the said push button being actuated a final time during the said advance. The watch will then be in the storage state on the preferred position of 10 hours 10 minutes. Contrary to what has been set forth concerning the first variant, wherein the minutes hand stops immediately at the moment of the storage pulse, this second variant does not give assurance immediately that the timepiece has been properly placed in a storage state, since its minutes hand will run through a complete time zone or revolution as happens during normal time setting of the hour. In order to be assured that the storage impulse has been correctly sent and received it is necessary to continue observation during a period of at most a minute in order to determine whether or not the minutes hand remains stationary, in which case it may be concluded that the storage order has been received. Such observation time may be considered as a loss of time, above all in the case where a large number of watches must be stored at the same time. It is the purpose of the third variant which will now be explained to provide an immediate assurance that the timepiece is in a storage state following running through the time zone or full revolution.

FIG. 2 is a block diagram showing the principle of the third variant of the invention. When the switch circuit 14 receives via line 15 the storage order the minutes hand will complete its revolution in view of counter 10 and line 17 as has already been explained in respect of the second variant. When the revolution is complete the switch circuit 14 provides via line 18 a discharge order to a delay circuit 19 which switches switching circuit 2 following a time period of at least one second to its 32 Hz input via line 20 and causes motor 4 to advance through at least one supplementary step. This advance is recorded by circuit 21 which via line 22 acts on the switch circuit 14 and interrupts the feed line 16. In other words in this third variant the minutes hand, responsive to the storage signal, completes its revolution, stops during a short time period, then steps through at least one step before the watch is placed in its storage state. This last variant enables, as is the case for the preceding variant, storing the watch in a state where the hands occupy a desired position. If said position is 10 hours 10 minutes the hands will be initially placed on the position 9 hours 9 minutes. Thereafter the long duration actuation is applied in order to effect a full revolution, during which the push button will be actuated again. The minutes hand will run through its revolution, will then stop a short instant at 10 hours 9 minutes, and finally will advance through one division in order to indicate 10 hours 10 minutes. The advance through an extra division is a release which certifies to the user that the storage has been correctly effected.

The invention does not limit the release to an advance of a single step. Advances comprising several steps may be foreseen and in particular an advance through a complete revolution.

In the three variants as foreseen hereinabove if the watch is to be restarted, normally the push button 5 will be actuated once again. As the circuit is arranged in order that push button 5 and the switch circuit 14 are permanently supplied with current the pulse coming from 5 will reactivate circuit 14 via line 23, which will have as effect to apply voltage to line 16, thus to feed the interrupted circuits controlled by the line 16.

It has been seen above that the time zone correction of one revolution is affected by a long duration actuation on push button 5. It will be understood that on releasing the push button a rebound of its switch or a false movement by the user may place the watch in a storage state which is undesired. For this reason a preferred version of the invention foresees that the user must operate twice at least on the push button in order to place the watch in its storage state. In this version counter 9 sends forth a signal to circuit 14 only in the event that two or more pulses have been counted.

If necessary this arrangement may be completed by certain circuits as set forth in the French patent application No. 79-25 528. In this application the arrangement of the circuits is such that it permits an automatic time setting of the watch following utilisation of the hands to indicate the minute and the second. On condition that the oscillator, divider and counter circuits remain permanently under tension and that use may be made of the real time counter, the reference counter for the position of the hands and the comparator which compares the contents of these two counters such as they have been described in the immediately cited application, one may provide the present invention with automatic time setting as soon as the push button has been actuated in order to end the storage state. In the same manner if the circuit includes a memory giving a preferred position of the hands in the storage state, a reference counter for the position of the hands and a comparator which compares the contents of the memory with the contents of the counter it will be understood that as soon as the storage pulse is sent, the hands will stop on the preferred storage position.

All these position changes may be effected in forward operation or in accordance with the shortest path as has been described in this latter patent application.

What we claim is:

1. Electronic timepiece comprising:

a time-base means including an oscillator and a frequency divider for providing time-keeping pulses;

a time-display means including at least an hour indicator and a minute indicator actuated by a stepping motor;

a manually actuable electric switch movable between first and second positions;

a pulse transmission-and-modification means coupled between said time-base means and said time-display means, and connected to said manual switch, for normally applying time-keeping pulses, at a time-keeping frequency, to said time-display means with said manual switch in said first position, but: in response to said manual switch being moved briefly from said first position to said second position, applying a pulse signal to said time-display means for advancing the minute indicator through a step of one minute; in response to said switch being moved from said first position to said second position and held there for a longer duration, applying pulses at a higher frequency to said time-display means to advance the minutes hand through an increment of one hour at an increased speed; and while said minute indicator is moving at said increased speed in response to said manual switch being actuated from said second position to said first position and back to said second position, stopping further movement of said minutes indicator to place the timepiece into a state of minimum energy consumption for storage purposes; and in response to a further actuation of said switch when said timepiece is in said state of minimum energy consumption, restarting movement of said minutes hand.

2. Electronic timepiece as set forth in claim 1 wherein the pulse transmission-and-modification means applies pulse signals such that the state of minimum energy consumption occurs at the instant of said switch actuation during minute indicator motion at increased speed, the minutes indicator being stopped during its revolution at increased speed.

3. Electronic timepiece as set forth in claim 1 wherein the pulse transmission-and-modification means applies pulse signals such that following said switch actuation during minute-indicator motion at increased speed, the minutes indicator completes its hour incremental motion, the timepiece then being stopped in the state of minimum energy consumption.

4. Electronic timepiece as set forth in claim 1 wherein the pulse transmission-and-modification means applies pulse signals such that following said switch actuation during the minute-indicator motion at increased speed, the minutes indicator completes its hour incremental motion, stops during a short time interval then advances through at least one stop, the timepiece then being stopped in the state of minimum energy consumption.

5. Electronic timepiece as set forth in claim 1 wherein the pulse transmission-and-modification means applies pulse signals such that following said switch actuation during the minute-indicator motion at increased speed, the minutes indicator completes its hour incremental motion, stops during a short time interval then advances through another complete hour incremental motion, the timepiece then being stopped in the state of minimum energy consumption.

6. Electronic timepiece as set forth in claim 1 wherein the pulse transmission-and-modification means applies pulse signals such that at least two of the said switch actuations during the minute-indicator motion at increased speed, must be effected in order to place the timepiece in the state of minimum energy consumption.

7. Electronic timepiece as set forth in claim 3 or claim 4 or claim 5 wherein during the state of minimum energy consumption the hours and minutes hands each display a predetermined value.

* * * * *

UNITED STATES PATENT AND TRADEMARK OFFICE

CERTIFICATE OF CORRECTION

PATENT NO. : 4,351,042

DATED : September 21, 1982

INVENTOR(S) : Ginalski et al.

It is certified that error appears in the above—identified patent and that said Letters Patent is hereby corrected as shown below:

Cover page, item [30], change French patent number of "79 27619" to -- 79 27618 --.

Signed and Sealed this

*Sixteenth* Day of *August 1983*

[SEAL]

*Attest:*

GERALD J. MOSSINGHOFF

*Attesting Officer*

*Commissioner of Patents and Trademarks*